United States Patent [19]

Ross

[11] 4,334,669

[45] Jun. 15, 1982

[54] JACKING MECHANISM FOR A PORTABLE SAWMILL

[76] Inventor: Warren K. Ross, Main St., W. Hampstead, N.H. 03841

[21] Appl. No.: 266,185

[22] Filed: May 22, 1981

Related U.S. Application Data

[62] Division of Ser. No. 76,905, Sep. 16, 1979, Pat. No. 4,275,632.

[51] Int. Cl.[3] ..... B66F 15/00

[52] U.S. Cl. ..... 254/130; 83/794; 254/131; 254/121; 254/120

[58] Field of Search ..... 254/130, 131, 121, 132, 254/120

[56] References Cited

U.S. PATENT DOCUMENTS

| | | | |
|---|---|---|---|
| 265,384 | 10/1882 | Chaffin | 254/131 |
| 298,765 | 5/1884 | Mitchell | 254/131 |
| 477,771 | 6/1892 | Morrill | 254/130 |
| 1,093,405 | 4/1914 | Hallen | 254/130 |
| 1,392,885 | 10/1921 | Battelle | 254/131 |
| 1,415,805 | 5/1922 | Cyrus | 254/129 |
| 1,458,530 | 6/1923 | Hilton | 254/130 |
| 2,693,935 | 11/1954 | Halbert | 254/131 |
| 2,718,375 | 9/1955 | Purdy | 254/131 |

*Primary Examiner*—Donald R. Schran

*Attorney, Agent, or Firm*—Morse, Altman, Oates & Dacey

[57] ABSTRACT

A portable sawmill is provided in which a rigid straight channel support is placed on a floor or on the ground with one end slightly elevated. A pair of longitudinally spaced log supports are mounted in the channel piece at a distance corresponding to the length of a log to be placed thereon. A carriage with rollers is mounted to ride along the upturned edges of the channel piece and is adapted to roll by gravity from the elevated end of the channel piece to the lower end. The carriage includes a bandsaw driven by a low horse power motor and is equipped with a release mechanism for automatically disengaging the drive between the motor and the saw at the end of a cutting stroke. A jacking mechanism and adjustable shelves on the log supports are included for raising the log to a new height after each cut.

6 Claims, 10 Drawing Figures

JACKING MECHANISM FOR A PORTABLE SAWMILL

This is a division of application Ser. No. 079,905 filed on Sept. 16, 1979 now U.S. Pat. No. 4,275,632.

BACKGROUND OF THE INVENTION

1. Field of the Invention

This invention relates generally to a sawmills and more particularly is directed towards a new and improved portable sawmill of simple, low cost, rugged construction having low power requirements and adapted to produce precision cut wood with very little waste.

2. Description of the Prior Art

A conventional sawmill typically utilizes a relatively large circular saw blade mounted along the path of travel of a log placed on a suitable moving bed with a drive mechanism for advancing the log against the blade. Typically, such sawmills are permanent installations located centrally to established logging operations and operated on a more or less continuous basis. Such mills normally are built only to service large tracts of forests capable of supporting a regular commercial mill. However, there are many situations where a commercial mill is not economically feasible or practical. For example, owners of relatively small tracts of forested land may wish to produce finished or semi-finished lumber from their own logs either for their own use or for resale. Even with large tracts of forested land it may be desirable in some instances to cut logs into finished and semi-finished products before transporting the wood out of the forest. In either of such cases it is desirable that a portable mill be available so that it may be moved about easily from one cutting location to another. While many types of portable sawmills have been available heretofore, none of these have been entirely satisfactory from the standpoint of cost, simplicity, precision of operation, ease of assembly, power requirements, portability and other factors.

Accordingly, it is an object of the present invention to provide improvements in portable sawmills. Another object of this invention is to provide a portable sawmill of simple, low cost construction, having low power requirements and adapted to cut wood to precision dimensions with very little waste.

SUMMARY OF THE INVENTION

This invention features a portable sawmill comprising an elongated base in the form of a U-shaped channel of rigid construction and a pair of supports movable lengthwise of the channel and adapted to hold the ends of a log placed thereon in cutting position. The mill includes a carriage equipped with rollers and mounted to move by gravity lengthwise along the channel piece when one end of the channel is elevated slightly above the opposite end. The carriage includes a band saw driven by a low horse power motor and a releasable drive mechanism adapted to be disengaged automatically at the end of a cutting stroke. The log supports includes adjustable shelves and a jack mechanism is provided for raising the log to a new cutting height after each pass of the carriage.

BRIEF DESCRIPTIONS OF THE DRAWINGS

FIG. 1 is a view in perspective of a portable sawmill made according to the invention, FIG. 2 is a top plan view of the carriage portion of the mill, FIG. 3 is a view in front elevation thereof, FIG. 4 is a view in side elevation thereof, FIG. 5 is a view in front elevation of a log support made according to the invention, FIG. 6 is a view in side elevation thereof, FIG. 7 is a top plan view thereof, FIG. 8 is a perspective view of a log jacking device made according to the invention, FIG. 9 is a side view of a combination jacking lever and adjustable cant hook made according to the invention, FIG. 10 is a view in side elevation of a dog spike made according to the invention.

DETAILED DESCRIPTION OF THE PREFERRED EMBODIMENTS

Figures 1, 8, 9, 10:
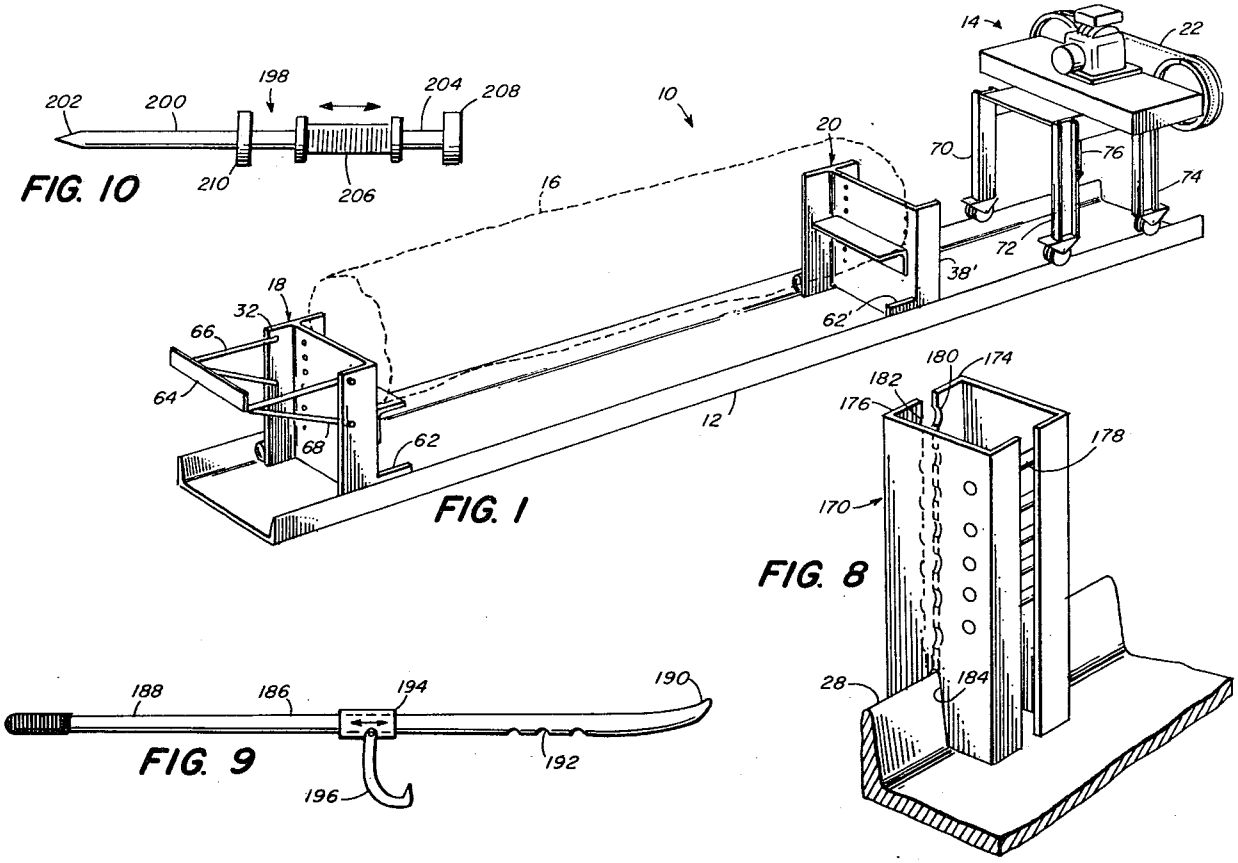
Figure 2:
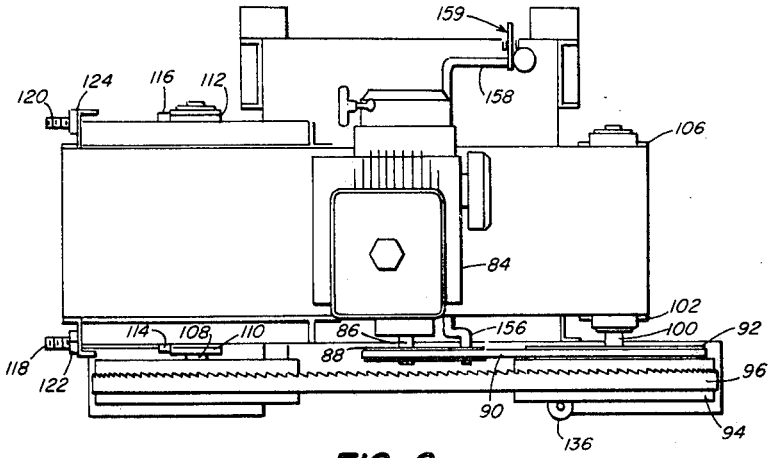

Referring now to the drawings, the reference character 10 generally indicates a portable sawmill comprised of an elongated rigid bed 12 providing a track for a carriage 14 moving therealong to cut a log 16 the ends of which rest on a pair of spaced log supports 18 and 20. The log supports 18 and 20 serve to hold the log in position while the carriage 14 moves lengthwise along the bed 12 to make a horizontal cut by means of a power driven band saw 22 on the carriage. Movement of the carriage is by means of gravity achieved by raising the right hand end of the bed 12, as shown in FIG. 1, slightly above the left hand end thereof by an angle of perhaps 5°.

The bed 12 in the preferred embodiment of the invention is fabricated from an elongated rigid steel channel piece, perhaps 18" wide and of a length of perhaps 15 to 20" depending upon the length of the logs to be cut. These dimensions are only by way of example and may be altered as required. The channel piece is formed with a flat bottom wall 24 and upright side walls 26 and 28 defining parallel rails for the carriage 14. The rails 26 and 28 typically are about 4" high and somewhat tapered, being wider at their bases than at their upper edges. The channel section forming the bed is extremely rigid and of one piece construction.

The bed may be placed on reasonably level ground or on the floor of a building, as required. In practice the bed should be placed so that it is as close as possible to the horizontal in a transverse direction while in a longitudinal direction one end should be raised slightly above the other end by an angle of perhaps 5° in order to provide an incline so that the carriage 14 will roll down the bed under the force of gravity at a moderate rate of speed.

Figure 7:
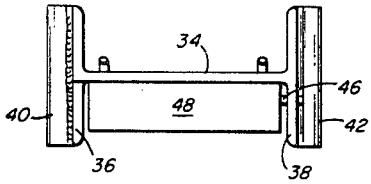

The log supports 18 and 20 are of similar construction, one being substantially the mirror image of the other except for a stop plate 30 carried by the log support 18. Otherwise each log support is comprised of a rigid frame member 32, preferably being formed from a structural steel element of "H" cross-section in top plan view, as best shown in FIG. 7 and comprised of a transverse center wall 34 and perpendicular end walls 36 and 38. The height of the frame member 32 typically is on the order of about 16" and the width is about 15" in order to fit loosely between the rails of the bed 12. Each log support is adapted to be movable to and from different locked positions along the length of the bed in order to accommodate logs of different lengths.

Figure 5:
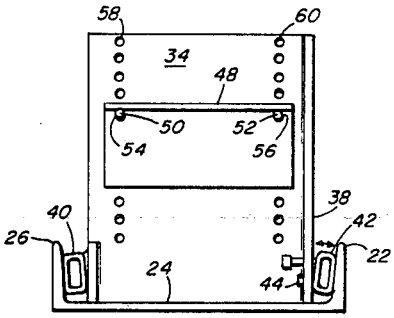

In the illustrated embodiment each log support is adapted to be locked and unlocked in any position along the channel by means of a pair of wedges 40 and 42, one on either side of the log support at the base thereof. The wedges are best shown in FIG. 5 where it will noted that the left hand wedge 40 is fixed against the bottom of the support as by welding and located in the gap between the bottom of the log support and the inner face of the side rails. The wedge typically is in the form of a short section of tubular steel of generally rectangular cross-section and is welded to the base of the support at a slight angle so that its outer face will come into substantially flush contact with the tapered inner face of the rail 26. The right hand wedge 42 is movable and of a size and shape similar to that of the wedge 40. However, the lower end of the wedge is loosely captured by a nut and bolt 44 while a locking screw 46 is threaded through the side wall 38 to bear against the top of the wedge 42. When the locking screw 46 is backed off, the wedge 42 is loose and allows the entire log support to be pushed along the channel to any selected position. Once the position is reached, the locking screw 46 is tightened, forcing the wedge 42 tightly against the rail 28 thereby locking the log support at that position.

Each of the supports 18 and 20 includes a shelf 48 on the top of which the log is adapted to rest during cutting operations. The shelf typically is a piece of sturdy angle stock having a width substantially equal to the distance between the side walls 36 and 38 of the support and adjustably mounted to the wall 34 by means of support hooks 50 and 52 which extend through openings 54 and 56 formed at the back corner of the shelf and through a pair of openings 58 and 60 formed in the back wall 34. The back wall is formed with a large number of openings 58 and 60 arranged in parallel rows spaced apart from one another and, in the illustrated embodiment, each row contains thirteen openings spaced apart perhaps one inch on centers. In this fashion the shelf 58 may be raised or lowered as required to accommodate logs of different thicknesses as well as to raise the log to successively different heights as each cut is made. Insofar as the band saw 22 operates at a fixed height, it is necessary to raise the log each time a cut is made lengthwise of the log.

Figure 6:
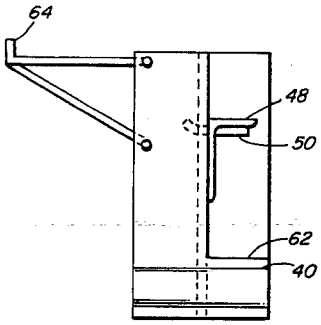

As shown in FIGS. 1 and 6 the side walls are 38 and 38' of the log supports 18 and 20 are cut away at 62 and 62' from a point slightly below the lower most pair of holes 58 and 60 to the top of the log support. The cutaway portions 62 and 62' allow the log 16 to be rolled on and off the shelf without interference. The opposite walls 36 and 36' are whole and serve to prevent the log from rolling off the opposite side of the support. During a cutting operation the band saw cuts in a direction towards the walls 36 and 36', causing the log to be pushed tightly against those walls and preventing the log from rolling off the shelf support. In practice the top of the shelf 48 and innerface of the side wall 36 form a true right angle and thereby aids in the production of precision cuts. Normally, the sawmill will make straight cuts to form boards, planks, beams etc. in which the opposing faces are parallel. However, in the event that a transverse taper is required, as when cutting clapboards, the same can be achieved by placing a shim under one part of the log in order to introduce the desired angular cut. The log supports 18 and 20, as previously indicated, essentially are mirror images of one another with the exception that the log support 18 is also provided with a stop 30. The stop 30 of the illustrated embodiment is in the form of vertical plate 64 attached to the rear part of the log support 18 by means of braces 66, 68. The plate 64 is located at the rear of the support 18 by a distance generally corresponding to the depth of the carriage 14 in order to allow the band saw to cut fully through the length of the log before the carriage is stopped. The stop also serves to disengage the drive mechanism to the band saw at the end of the cutting stroke, as will be described in detail below.

Figure 3:
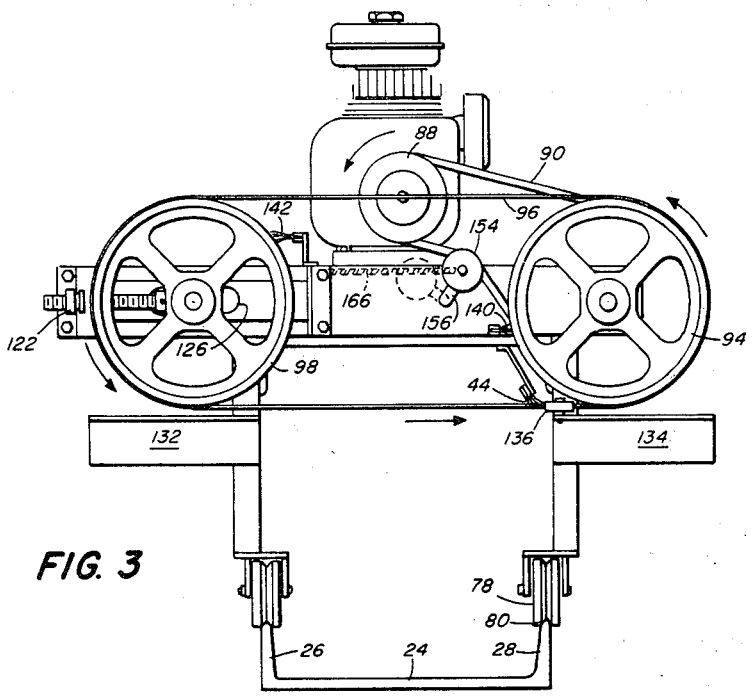

The carriage 14, in the illustrated embodiment, is in the form of a table having four supporting legs 70, 72, 74 and 76, one at each corner of the table. The legs 70 and 76 are spaced from legs 72 and 74 by a distance generally corresponding to the width of the bed 12 and of a height sufficient to clear not only the log support 18 and 20 but the log 16 as well. At the lower end of each of the legs there is mounted a roller 78, preferably of steel and formed with an annular V-groove 80 about the periphery thereof. The grooved roller thus rides against the upper edges of the rails 26 and 28, as best shown in FIG. 3.

The carriage includes a horizontal platform 82 on the top of which is mounted a motor 84. In the preferred form of the invention, a low horse power gasoline engine is employed and, in practice, it has been found that a five horse power, four cycle, air-cooled gasoline engine provides very satisfactory results. The engine is provided with a drive shaft 86 on the end of which is mounted a pulley 88 connected by a belt 90 to a pulley 92 drivingly connected to a band wheel 94 about which is looped the band saw 22. A similar band wheel 98 is mounted on the opposite side of the platform in the same horizontal plane as the wheel 94. In practice the wheels 94 and 98 are rubber covered steel wheels of equal size mounted to rotate about spaced parallel axes with the wheel 94 carried by a shaft 100 supported by fixed bearings 102 and 106. The wheel 98 is supported on a shaft 108 carried by movable bearings 110 and 112 to allow for tensioning of the band saw blade 22 when required and also to allow the band saw to be replaced from time to time. The bearings 110 and 112 are carried by blocks 114 and 116 attached to lead screws 118 and 120 extending to one side of the carriage and provided with nuts 122 and 124. By selectively adjusting the nuts 122 and 124, the bearings 110 and 112 together with the shaft 108 can be moved back and forth within a guide slot 126 in order to align the shaft 108 with the shaft 100 and also to apply tension to the band saw as needed as well as to move the wheel 98 towards the wheel 94 when replacing a blade.

The cutting teeth of the blade face towards the table so that cutting takes place at the trailing end of the carriage as it moves along the bed. With the blade teeth facing inwardly and protected by the mass of the carriage itself, there is little danger of the operator being hurt by the machine. In addition, the wheels 94 and 98 are substantially enclosed by means of a guard 128 secured at its upper ends by means of a latch 130 and hinged along its lower end to outwardly extending brackets 132 and 134. The bracket 134 also carries guide rollers 136 and 138 with the roller 136 engaging the straight edge of the band saw as an aid in holding the band saw in position on the wheel. In practice the blade tends to wander somewhat over the periphery of the wheel and guide rollers 136 and 138 serve to prevent the band saw from wandering completely off the wheel. The guide roller 138 is mounted in a position proximate to the cutting teeth of the band saw but, in practice, the band saw tends to remain closer to the roller 136. This is due to the cutting action taking place in which the force is to the right is viewed in FIG. 4. Also the shaft 108 may be tilted to a very slight extent so as to cause the blade to track towards the right hand portion of the wheels insofar as the cutting edge of the blade would quickly ruin the guide roller 138 if it were to engage it during operation.

Also associated with the wheels and band saw are wheel cleaning brushes 140 and 142 mounted in position to clean the peripheries of the wheels and a blade cleaning brush 144 is positioned to clean the blade directly after it leaves the cut in the log. Insofar as any sawmill will produce a fair amount of sawdust, the function of the brushes is to keep the moving surfaces clear of sawdust and thereby provide a more efficient driving action between the wheels and the blade. Other cleaning brushes may be employed in other parts of the apparatus. For example, in FIG. 4 a track cleaning brush 146 is mounted on at least two of the legs, one on either side of the carriage. The function of the track cleaning brush 146 is to keep sawdust and other foreign matter clear of the tracks so that the carriage will move smoothly along the bed. It will be understood that if materials such as sawdust, pebbles, twigs etc. were to collect on the tracks, such would result in the production of an uneven cut in the log.

Figure 4:
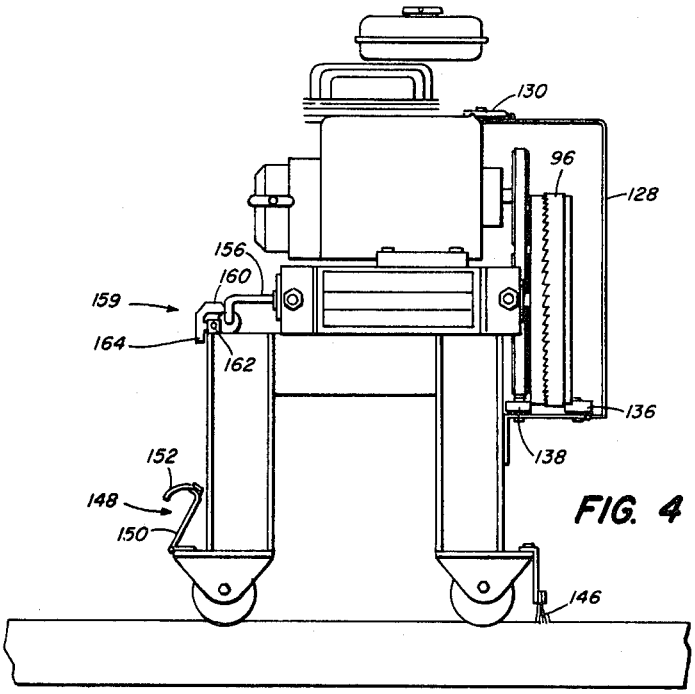

The carriage may also be locked against rolling by means of a brake 148 shown in FIG. 4. The brake is comprised of a hinged plate 150 carrying at its outer end a flexible rubber flap 152. In the folded back position shown in FIG. 4, the carriage is free to roll along the tracks. However, if the hinged plate 150 is swung down so that the flap will move under the carriage wheel, this will serve to lock the wheel against movement to hold the carriage in place.

The drive between the motor 84 and the band saw wheels 94 and 98 is through the belt and pulley system as previously described. The belt 90 is looped over the pulleys 88 and 92 and the driving engagement between these pulleys is controlled by means of idler pulley 154. The idler pulley 154 is rotatably mounted on one end of a crank 156. The crank 156 extends from front to rear of the carriage through the top portion thereof and is adapted to swing from a driving position, shown in full line in FIG. 3, to an idle position, shown in dotted line in FIG. 3.

When the crank is in its driving position, the pulley 154 engages the belt 90 and applies sufficient tension on it to cause the engine pulley 88 to transmit power to the pulley 92. When the crank is flipped counterclockwise so that the idler disengages the belt 90, no power is transmitted and the pulley 88 slips against the belt 90.

The crank position is controlled by means of a lever arm 158 on the opposite side of the carriage, which lever arm is adapted to be held in a downward position by means of a latch 159 attached to the frame of the carriage. The latch illustrated includes a hooked upper end 160 adapted to engage the top of the lever 158 and is pivoted to the carriage frame at 162. The lower end of the latch includes a leg 164 which is in a position to engage the stop plate 64 extending to the rear of the log support 18 when the carriage completes a cut through the log. At the start of a cutting operation the lever 158 is swung down and the latch is engaged to hold the lever down. In this position the idler pulley 154 engages the belt causing power to be transmitted to the band saw. The carriage brake may then be released and by gravity will roll down the tracks fully cutting through the length of the log. Once it has passed entirely through the log the leg 164 of the latch will strike against the stop plate which will cause the latch to disengage the lever and also stop the carriage. When the latch disengages the lever, a spring 166 will cause the crank to rotate in a clockwise direction as viewed in FIG. 3, flipping the idler pulley 154 out of engagement with the belt and stopping the band saw.

Insofar as the band saw 96 is quite thin as compared to a conventional circular saw commonly used in mills much less waste will be encountered. Typically, the kerf using a band saw will be approximately 1/32" as opposed to about a $\frac{1}{4}$ in a conventional mill. This not only allows the use of a much lower horse power motor or engine, but also increases the yield of usable wood from a log by perhaps 20%. Band saw blades are relatively inexpensive and once they become dull they may be discarded rather than having to be sharpened and set as is the case with a conventional circular saw blade. Band saw blades are relatively safe and are more quiet than circular saws and produce a very smooth, finished cut on the wood.

After each pass of the carriage producing a cut along the log, it is necessary to raise the log to a new cutting height in preparation for the next cut. This is done by jacking up the log, raising the shelves 48 on the log supports 18 and 20 and then setting the log down on the shelves in their new position. The height to which the shelves are raised will depend upon the thickness of the board to be cut.

While various jacking means may be employed to lift the log while the shelves are being raised, FIGS. 8 and 9 illustrate a unique jacking mechanism especially adapted for this purpose. The mechanism includes a fulcrum 170 and a combination lever and cant hook 172. The fulcrum 170 is comprised of a pair of channel members 174 and 176 assembled together in slightly spaced parallel relation by means of a set of rungs 178 spaced therealong towards the front edge thereof. Along the rear of the fulcrum and formed in the opposing flanges thereof are semi-circular cut-out sections 180 and 182 arranged in pairs spaced along the height of the fulcrum. The lower end of the fulcrum is formed with a cutaway section 184 generally conforming to the cross sectional shape of the rail in the bed 12 so that when the fulcrum is slipped over the rail edge in the manner illustrated, the fulcrum will be mounted in a generally upright position.

The combination lever and cant hook is comprised of an elongated bar 186 formed with a handle 188 at one end and a slightly up turned tip 190 at the opposite end. The bar includes a series of notches 192 adapted to fit over a rung 178 of the fulcrum. A tubular slide lock 194 is mounted over the shank of the lever and is adaptedly to be slipped in and out of any pair of semi-circular openings 180 and 182.

The device is used by placing the fulcrum near one end of the log and setting it on the rail in the manner shown. The lever is passed through the fulcrum above a rung close to the lower edge of the log so that a notch 192 will rest on that rung. The tip 190 is then under the log and, by pressing down on the handle 188, a levering action is provided to raise the log. Once the log is raised to the desired height the slide lock 194 is slipped forwardly between a pair of cut outs 180 and 182 into which it will fit snugly so as to lock the lever at that angular position. Once the shelf has been raised the slide lock is then pulled back and the lever is released allowing the log to drop down onto the shelf and at the new cutting position. The operation is then repeated on the opposite end of the log.

The slide lock can also be provided with a pivoted hook 196 whereby the device may serve the double function of being a cant hook capable of adjustment to accommodate logs of a wide variety of sizes. With the slide lock slipped forwardly towards the tip, the cant hook may be used with small diameter logs whereas for larger logs the cant hook and slide are moved back towards the handle portion of the tool.

Referring now to FIG. 10 of the drawings there is illustrated a novel dog spike used for holding a log in position on the shelves during a cutting operation. The dog spike is primarily used when the lower part of the log is still uncut so as to prevent the log from rolling. Once the log is resting on a flat cut surface the dog spike is not needed. The dog spike 198 is comprised of an elongated spike 200 with a pointed tip 202 and an elongated shank 204 on which is mounted a movable handle or spool 206. This spike is formed with a large head 208 at one end and a medial collar 210. The device is used by inserting the tip 202 through one of the openings 58 or 60 in the log support where it can be driven into the end of the log. The device is driven into the log by using the spool 206 as a handle gripping the spool and sliding it rapidly and forcefully against the collar 210 until the log is dogged down. The device is removed by reversing the operation and rapidly driving the spool 206 against the head 208 until the spike comes loose.

While the invention has been described with particular reference to the illustrated embodiments, numerous modifications thereto will appear to those skilled in the art. For example, instead of employing a gasoline engine to drive the band saw an electric motor may be used where electricity is readily available.

Having thus describe the invention, what I claim and desire to obtain by Letters Patent of the United States is:

1. A jack for raising and lowering heavy objects, comprising (a) a fulcrum, and, (b) a lever, (c) said fulcrum being formed with a pair of spaced apart parallel vertical walls, one wall having at least one fulcrum edge (d) the other vertical wall spaced from said edge and defining a vertical slot opposite said edge and at least one recess in said wall along said slot, (e) said lever including a sleeve movable lengthwise of said lever and adapted to engage said recess when said lever is against said edge and aligned with said recess whereby said lever may be locked in position against said fulcrum.

2. A jack according to claim 1 wherein said fulcrum is formed with a plurality of vertically spaced recesses in said wall.

3. A jack according to claim 2 wherein said fulcrum is formed with a plurality of vertically spaced edges.

4. A jack according to claim 1 wherein the object engaging end of said lever is formed with a bent tip.

5. A jack according to claim 4 including a hook pivotally connected to said sleeve whereby said lever may be used as an adjustable cant hook.

6. A jack according to claim 1 wherein said fulcrum is formed with a transverse notch across the base thereof for engagement with a cooperating flange for support thereof proximate to said object.

* * * * *